US007438188B2

(12) United States Patent
Stolworthy

(10) Patent No.: US 7,438,188 B2
(45) Date of Patent: Oct. 21, 2008

(54) DEVICE FOR USE IN PLACER MINING OPERATIONS AND METHOD

(76) Inventor: Wade Stolworthy, 676 W. 800 South, Alpine, UT (US) 84004

( * ) Notice: Subject to any disclaimer, the term of this patent is extended or adjusted under 35 U.S.C. 154(b) by 0 days.

(21) Appl. No.: 11/655,366

(22) Filed: Jan. 19, 2007

(65) Prior Publication Data

US 2007/0170099 A1 Jul. 26, 2007

Related U.S. Application Data

(60) Provisional application No. 60/760,996, filed on Jan. 20, 2006.

(51) Int. Cl.
*B07B 1/00* (2006.01)

(52) U.S. Cl. ..... 209/44; 209/13; 209/268; 209/427; 209/493; 209/500; 209/506

(58) Field of Classification Search ..... 209/13, 209/18, 44, 44.2, 268, 423, 427, 437, 440, 209/443, 493, 500, 501, 506, 906, 910
See application file for complete search history.

(56) References Cited

U.S. PATENT DOCUMENTS

| | | | | | |
|---|---|---|---|---|---|
| 563,046 | A | * | 6/1896 | Mait | 209/440 |
| 1,035,930 | A | * | 8/1912 | Willma | 209/441 |
| 1,041,892 | A | * | 10/1912 | Sieling | 209/677 |
| 1,915,602 | A | * | 6/1933 | Goody | 209/273 |
| 1,947,035 | A | | 2/1934 | Covington | |
| 2,001,756 | A | | 5/1935 | Woock | |
| 2,006,596 | A | | 7/1935 | Mendenhall | |
| 2,014,249 | A | | 9/1935 | Fletcher | |
| 2,128,918 | A | * | 9/1938 | Dickerson | 209/467 |
| 2,269,307 | A | * | 1/1942 | Dickerson | 209/467 |
| 2,457,018 | A | * | 12/1948 | Wantling | 209/267 |
| 2,588,088 | A | * | 3/1952 | Cover | 209/269 |
| 2,825,462 | A | * | 3/1958 | Hackney et al. | 209/430 |
| 3,207,306 | A | | 9/1965 | Butler | |
| 3,255,885 | A | * | 6/1966 | Burls | 209/314 |
| 3,605,767 | A | * | 9/1971 | Ettlinger et al. | 134/62 |
| 4,199,441 | A | | 4/1980 | Ross | |
| 4,206,046 | A | | 6/1980 | Haight | |
| 4,525,270 | A | | 6/1985 | McCann | |
| 4,642,180 | A | | 2/1987 | Kaufman | |
| D302,018 | S | | 7/1989 | Messenger et al. | |
| 5,108,584 | A | | 4/1992 | Brosseuk | |
| 5,421,461 | A | | 6/1995 | Ruzic | |

(Continued)

*Primary Examiner*—Joseph C Rodriguez
(74) *Attorney, Agent, or Firm*—Thorpe North & Western LLP

(57) ABSTRACT

An aggregate material separating device includes a frame with a shaker mechanism. A trough is disposed on the frame and coupled to the shaker mechanism by a shaker spring. A hopper is disposed at an end of the trough and can receive a load of aggregate material. A hopper wash line is disposed adjacent the loading hopper to irrigate the aggregate material in the hopper forming a slurry. A brush and a backwash spigot form a standing wave in the trough to slow slurry movement from through the trough in order to provide additional settling time for the slurry. A mineral separation bed is disposed along a bottom and side of the trough. The mineral separation bed has a plurality of substantially longitudinal riffles that can be sized, shaped and oriented to capture minerals of a predetermined specific gravity from the slurry as the shaker shakes the trough.

11 Claims, 4 Drawing Sheets

U.S. PATENT DOCUMENTS 5,896,997 A 4/1999 Tanner
6,216,367 B1 4/2001 Tubbs
7,093,719 B2 * 8/2006 Roper ..... 209/420

* cited by examiner

DEVICE FOR USE IN PLACER MINING OPERATIONS AND METHOD

PRIORITY CLAIM

This application claims benefit of U.S. Provisional Application No. 60/760,996, filed Jan. 20, 2006, which is herein incorporated by reference in its entirety for all purposes.

BACKGROUND OF THE INVENTION

1. Field of the Invention

The present invention relates generally to placer mining machinery, and more particularly to devices for separating heavy minerals from aggregate material.

2. Related Art

Small volumes of valuable minerals may be present in naturally occurring aggregate materials, and also in processed ore, or tailings, from mining processes such as dredging, dry washing, sluicing, and trammeling. Recovery of the small volume of minerals from such placer ore has had little if any commercial value because of the large recovery cost in manpower, equipment time, etc. as compared to the value of the minerals. Various types of devices have been developed to try to recover precious metals, minerals and gemstones from these natural or processed aggregate placer ores.

One of the oldest types of equipment used is the sluice. In a sluice, aggregate materials are mixed with water in an inclined trough or flume where heavy particles such as gold, diamonds, etc. sink to the bottom of the trough where they can be recovered. One problem with sluice separators is that they are unable to separate and recover very fine mineral particles, such as black sand and gold flour, from mineral bearing placer ore.

Other devices have been developed that attempt to use the specific gravity of various minerals to separate out the heavier minerals from the placer ore. These devices have had problems keeping the extremely fine particulates of the heavier minerals from being washed away with the discarded aggregate material.

SUMMARY OF THE INVENTION

It has been recognized that it would be advantageous to develop a method and device for separating and classifying various constituents of aggregate materials. In addition, it has been recognized that it would be advantageous to develop a method and device for separating valuable trace minerals from placer ore. Furthermore, it has been recognized that it would be advantageous to develop a method and device for separating extremely small particulates of heavier minerals from placer ore.

The invention provides an aggregate material separating device including a frame with a shaker mechanism. A trough is disposed on the frame and coupled to the shaker mechanism by a shaker spring. A loading hopper is disposed at an upstream end of the trough and can receive a load of aggregate material. A water supply irrigates the aggregate material in the hopper forming a slurry. A brush is disposed in the trough above the mineral separation bed to slow slurry movement from the trough to the mineral separation bed in order to provide additional settling time for the slurry. A backwash spigot can be disposed in the trough above the mineral separation bed to spray a continuous flow of water toward the brush in order to create a standing wave. The standing wave can drive the slurry away from the mineral separation bed at an angle in order to provide for additional settling time for the slurry. A mineral separation bed is disposed along a bottom and side of the trough.

In a more detailed aspect of the present invention, the mineral separation bed can have a plurality of riffles that can be sized, shaped and oriented to capture minerals of a predetermined specific gravity from the slurry as the shaker shakes the trough. A plurality of collection tubes can be coupled to each of the plurality of riffles to collect the minerals of predetermined specific gravity collected within the riffles.

In another more detailed aspect, the present invention can include a plurality of separating screens disposed in the trough adjacent the loading hopper that separates particles of a predetermined size from the slurry while allowing the remaining slurry to pass through the screens.

The present invention also provides for method for separating various constituents of an aggregate including placing a load of aggregate material in a hopper of an aggregate separation device. The aggregate material in the hopper can be irrigated to form a slurry. The separation device can be shaken to cause smaller particles of the slurry to pass from the hopper, through at least one separator screen below the hopper, and into an upstream end of a trough disposed below the at least one separator screen. The flow of the slurry from the upstream end of the trough toward a downstream end of the trough can be restricted with a brush and a substantially continuous flow of water from a backwash spigot. The flow of water from the backwash spigot can form a standing wave adjacent the brush to drive the slurry upstream in order to provide time for heavier aggregate constituents to settle in the slurry. The trough can be shaken to move the slurry into a plurality of substantially longitudinal riffles extending from an upstream bottom of the trough to an elevated position along a side of the downstream end of the trough. Each riffle can be sized, shaped and oriented to separate minerals from the slurry by specific weight. The separated minerals collected in the plurality of substantially horizontal riffles can be removed from the aggregate material separation.

Additional features and advantages of the invention will be apparent from the detailed description which follows, taken in conjunction with the accompanying drawings, which together illustrate, by way of example, features of the invention.

DETAILED DESCRIPTION

Figure 1:
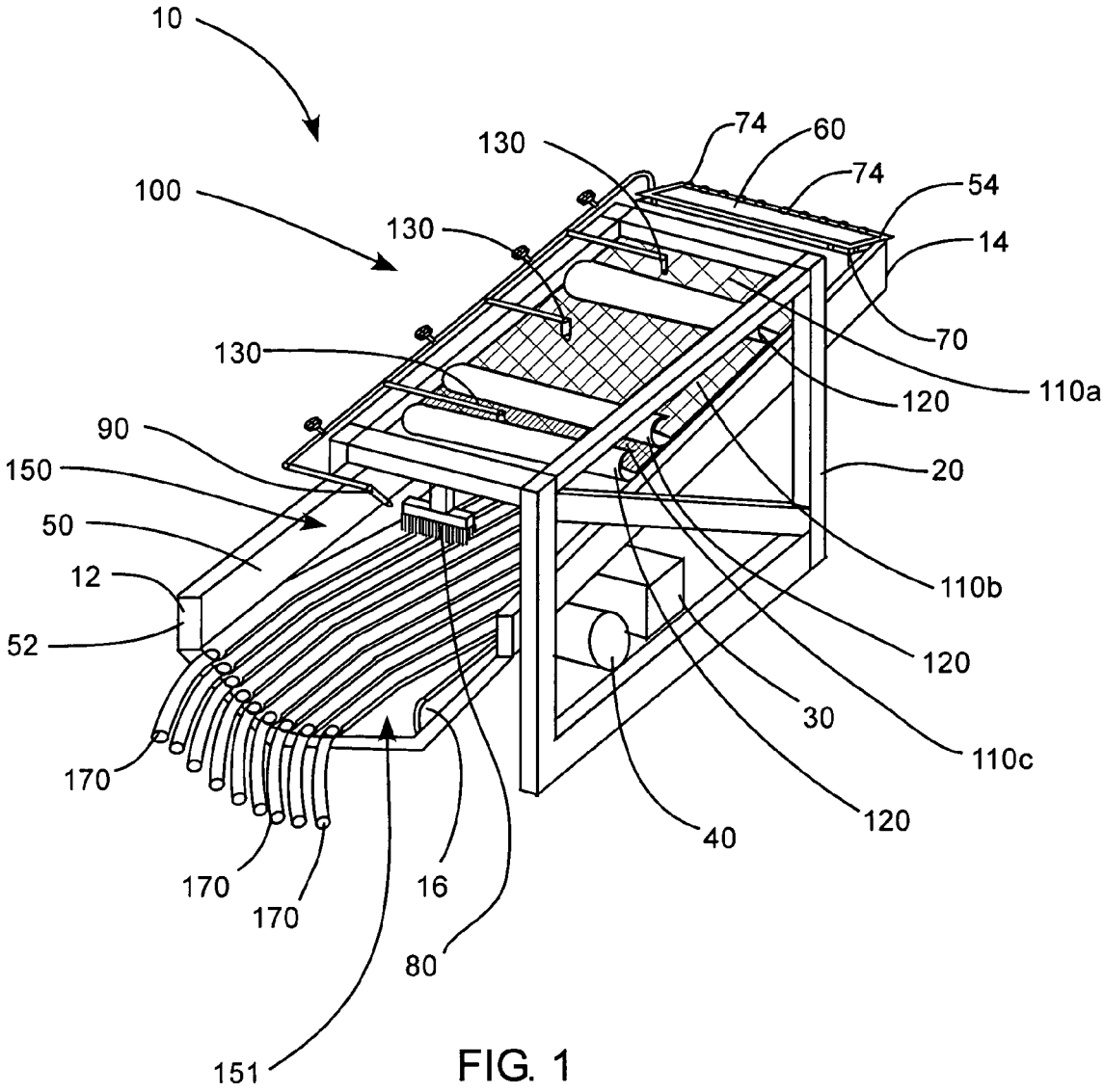
FIG. 1 is a perspective view of an aggregate separation device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention generally provides for an aggregate material separating device for use in placer mining and/or the separation of any aggregate material by elutriation and processes involving differentiation by means of specific gravity, such as shaking or vibration. The machine is operated by loading the aggregate material to be separated into a loading hopper. Once in the hopper, the aggregate material sits atop a solid plate angled downward towards the back or rear of the machine and is subjected to a continuous overhead flow of water, thus creating, a thick slurry which is washed towards the rear of the machine through a channel and onto a plurality of separation screen decks. The screen decks are made of increasingly tighter woven material (i.e. larger particles may pass through screen deck one than may pass through screen deck two, etc.) and are all inclined towards the front of the machine. Once the material reaches the first screen deck, the frequency motion of the machine, created by an engine and shaker springs, shakes the material forward towards the front of the machine and up the inclined screen deck. Material small enough to pass through the first screen deck falls through and is deposited on a subsequent screen deck. Larger material which may not pass through the first screen deck is ejected from the machine by way of the curved ejection tube located at the top of the first screen deck.

Once the material reaches the trough it is fairly uniform in size. The overhead streams of water passing through the screen decks above continue to create a slurry out of the material, and because the material is made up of relatively smaller particles, the slurry is now high in water content. The materials contained in this slurry slowly settle to the bottom of the trough and are shaken forward towards the front of the machine. A brush acts to restrict the forward movement of the materials contained in the slurry, thereby making certain that the material in slurry form is not moved forward too quickly, and, thus providing additional settling time for relatively heavier minerals contained in the slurry. The slurry and materials settling out of the slurry are also met by jets of water in front of the brush, which create a standing wave and drive the slurry towards the back of the machine at an angle to wash away relatively lighter materials and provide for additional settling time. Material which is so light that it will not settle is washed up and over a dam. The dam is inclined downward towards the back of the machine causing this lighter material to exit the back of the machine in liquid form. The back of the machine is sealed so that only material carried over the dam may exit the back of the machine. Heavier material is shaken forward around the brush and standing wave, and into a plurality of riffles extending substantially longitudinally along a bottom and up a sidewall of the trough. The specific density of each particle determines into which riffle the mineral will settle into. Heavier particles are deposited into riffles positioned at a higher elevation on the sidewall of the trough. Collection receptacles, such as tubes, are coupled to the end of the riffles and allow the operator to attach collection containers, such as bottles, which capture the separated minerals.

Figure 2:
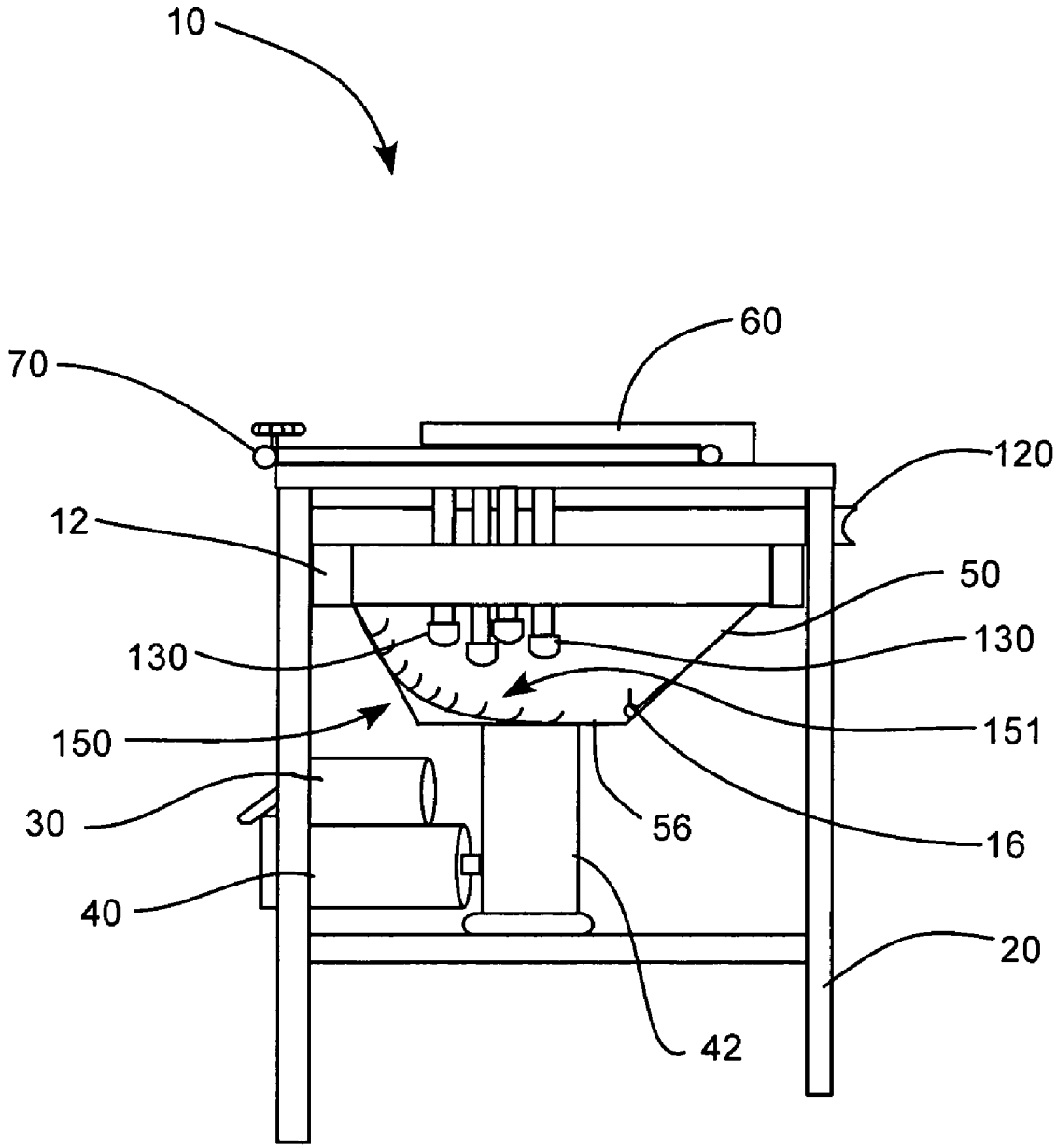
FIG. 2 is a front view of the aggregate separation device of FIG. 1.
Figure 3:
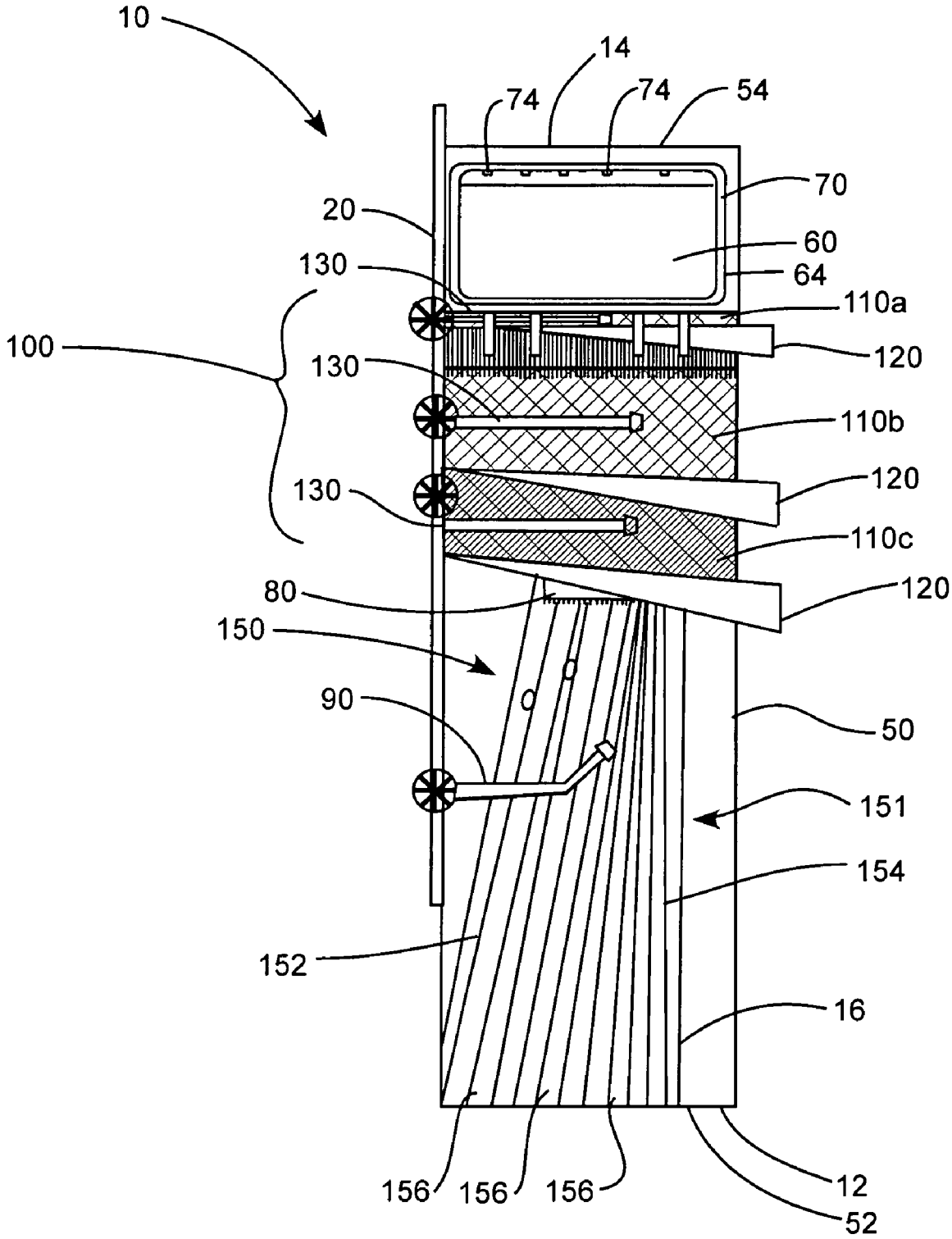
FIG. 3 is cross sectional side view of the aggregate separation device of FIG. 1.
Figure 4:
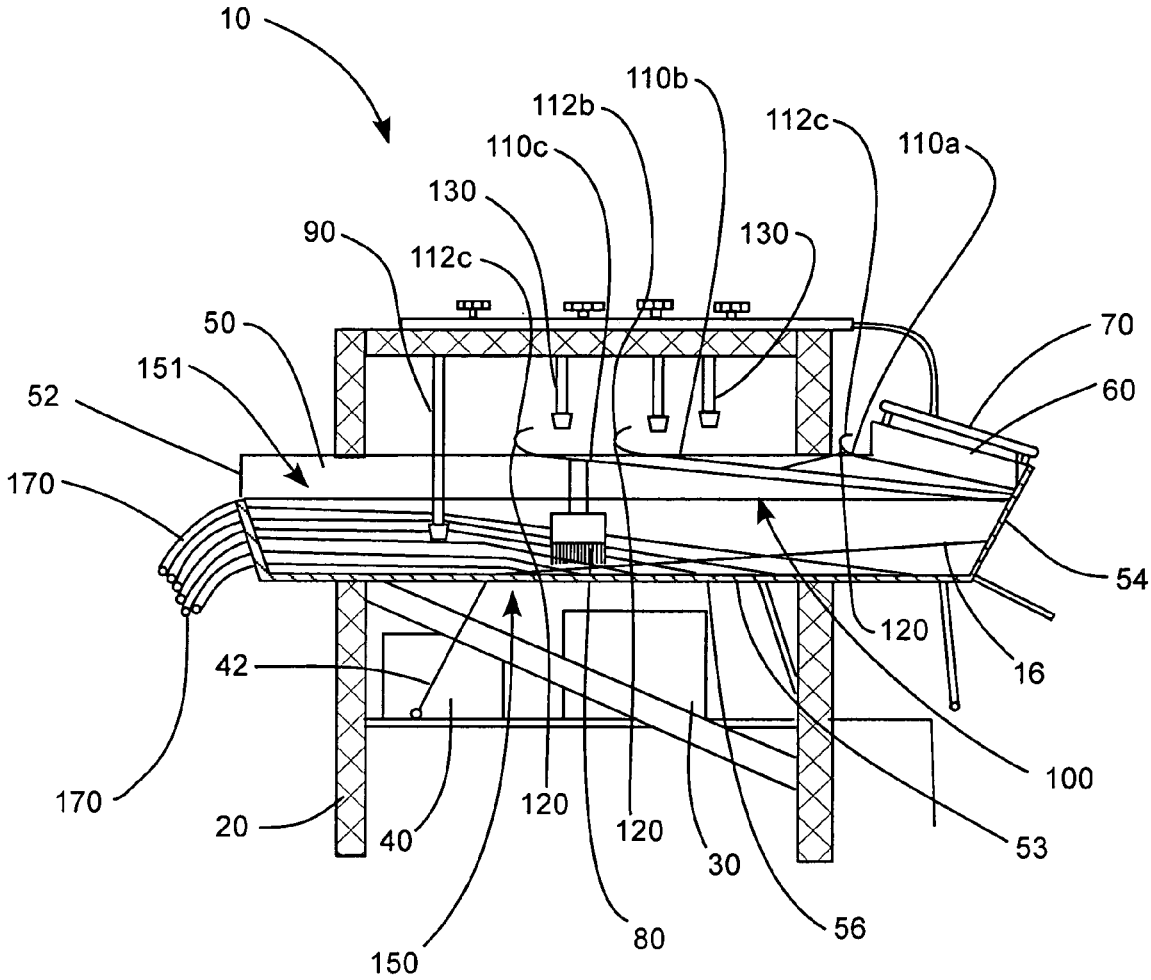
FIG. 4 is a top view of the aggregate separation device of FIG. 1.

As illustrated in FIGS. 1-4, an aggregate material separation device, indicated generally at 10, in accordance with the present invention is shown for use in separating heavier minerals from an aggregate material, such as dirt, ore, placer ore, mine tailings, gravel, and the like. It will be appreciated that such aggregate material can be a naturally occurring aggregate material containing various size rocks and gravel, or the aggregate material can be placer ore containing a variety of valuable minerals such as gold, silver, platinum, and the like. Additionally, the separation device 10 of the present invention can also separate, or classify by size, weight and specific gravity, other types of aggregate material.

The aggregate material separation device 10 can have a frame 20 that is disposable on a support surface. An engine 30 can be coupled to the frame and a shaker mechanism 40 can be coupled to the frame 20 and the engine 30. The engine 30 can operate the shaker mechanism 40 which can shake the aggregate material separating device 10.

The separation device 10 can also have a trough 50 disposed on the frame 20. The trough 50 can extend from an upstream end 54 to a downstream end 52. The trough 50 can be sized and shaped to contain and move a slurry of aggregate material from the upstream end 54 to the downstream end 52.

The trough 50 can be coupled to the shaker mechanism 40 by a shaker spring 42 such that when the shaker mechanism 40 shakes, vibrations can be transferred from the shaker mechanism to the trough. In one aspect, the shaker spring 42 can be coupled between the frame 20 and the trough 50 so that as the shaker mechanism 40 vibrates the frame, the vibrations are transferred through the frame to the shaker spring and to the trough. In another aspect, the shaker spring 42 can directly coupled the trough 50 to the shaker mechanism 40. The shaker mechanism 40 and the shaker spring can allow the trough 50 to be shaken or vibrated at a predetermined frequency in order to separate minerals from the aggregate material slurry.

A loading hopper 60 can be disposed at the upstream end 54 of the trough 50. The loading hopper 60 can be sized and shaped to receive a load of aggregate material. A water supply, such as a hopper wash line 70, can be disposed adjacent the loading hopper 60. The hopper wash line 70 can extend around an upper peripheral edge 64 of the loading hopper 60. The hopper wash line 70 can be coupled to a water source and can have a plurality of nozzles 74 that can supply a substantially continuous overhead flow of water into the hopper 60 to create a slurry from aggregate material placed in the hopper 60. It will be appreciated that in another aspect other liquids can be used to form the slurry, or, in yet another aspect, forced or pressurized air can be used to separate and process the aggregate material.

A plurality of separating screens, indicated generally at 100, can be disposed between the hopper 60 and the trough 50. Each screen can be sized and shaped to receive aggregate material slurry and separate particles of a predetermined size from the slurry while allowing the remaining slurry to pass through the screens 100. In this way, the plurality of screens 100 can be positioned successively downstream and each successive screen can filter out a successively smaller sized aggregate particle from the slurry. Thus, each screen in the plurality of screens 100 can have openings sized and shaped to separate relatively smaller aggregate particles from the slurry with respect to an adjacent upstream screen while allowing the remaining slurry to pass through to the next adjacent downstream screen.

In one aspect, the plurality of screens 100 can have three screens or screen decks, 110*a*, 110*b*, and 110*c* and each screen can have increasingly smaller openings so that larger particles may pass through the first screen deck 110*a* than may pass through the second screen deck 110*b*. Similarly, larger particles may pass through the second screen deck 110*b* than may pass through the third screen deck 110*c*. Additionally, each screen can be inclined towards the front 12 of the device 10 so that an upper end of each screen is nearer the front of the device 10.

A plurality of wash nozzles 130 can be coupled to the frame 20 above the plurality of separating screens 100. The wash nozzles 130 can supply a substantially continuous overhead flow of water to the aggregate material slurry.

Thus, in use, when the slurry material reaches the first screen 110*a*, the frequency of the vibrating or shaking motion of the device 10 created by the engine 30, the shaker mechanism 40 and the shaker springs 42, can shake the slurry material forward towards the front 12 of the device 10 and up the inclined screen 110*a*. Material small enough to pass through the first screen 110*a* falls through and is deposited on the second screen 110*b*. Larger material which may not pass through the first screen 110*a* can be ejected from the device 10 by way of a curved ejection tube 120 located at the upper end 112*a* of the first screen deck. Material that can pass through the first screen 110*a* and onto the second screen deck can again be subjected to an overhead stream of water which maintains the material in slurry form. The material can again be shaken forward towards the front 12 of the device 10 and material small enough to pass through the smaller openings of the second screen 110*b* can be deposited upon the third screen 110*c*. Material which is too large too pass through the second screen 110*b* can be removed from the machine by way of the curved ejection tube 120 located at the upper end 112*b* of the second screen deck. Material that is too large to pass through the screen deck, but which is too heavy to be shaken forward can be trapped by the nugget trap 140. Material that can fall through the second screen 110*b* and is deposited upon the third screen 110*c* can further be washed by an overhead stream of water and again shaken forward towards the front 12 of the device 10. Material that is small enough to pass through the third screen 110*c* can be deposited atop a mineral separation bed 150 in the trough 50 below the third separation screen, and behind a brush 80. Material which is too large to pass through the third screen 110*c* can be removed from the device 10 by way of the curved ejection tube 120 located at the upper end 112*c* of the third screen 110*c*.

The mineral separation bed, indicated generally at 150, can be disposed along a bottom 56 and side 58 of the trough 50. The mineral separation bed 150 can have a plurality of riffles, shown generally at 151, with an uppermost riffle 152, a lowermost riffle 154, and plurality of intermediate riffles 156 disposed between the uppermost and lowermost riffle 152 and 154, respectively. The plurality of riffles 151 can be inclined and can extend substantially longitudinally along a length of the trough 50 from an upstream position 53 in the trough to the downstream end 52 of the trough. Thus, the plurality of riffles 151 can extend from the bottom 56 of the trough 50 near the upstream end 54 of the trough 50 to an elevated position along the sidewall 56 of the trough 50 near a downstream end 52 of the trough 50.

Additionally, each riffle or rib can be sized, shaped and oriented to capture minerals of a predetermined specific gravity from the slurry. In one aspect, each riffle in the plurality of riffles 151 in the mineral separation bed 150 can have a predetermined angular orientation with respect to the mineral separation bed 150. The angular orientation of the riffle with respect to the mineral separation bed can facilitate capture and retention of minerals having an associated specific gravity.

It is a particular advantage of the present invention that the riffles 151 are sized, shaped and oriented in order to separate various constituents of aggregate materials by specific weight. Specifically, each constituent or mineral can be collected into a separate riffle or rib as the shaking of the device 10 moves the slurry past the brush and along the inclined riffles. Thus, gold can be collected in one riffle, while silver can be collected in another, and platinum in another, etc. Additionally, the quality of the specific material collected in each riffle can be determined and controlled so that certain riffles can separate a particular mineral of a particular quality or concentration.

Mercury can also be separated into a distinct path and collected separately from other aggregate material constituents. It will be appreciated that mercury is a highly toxic byproduct of many mining operations and is consequently found in many previously processed placer ore deposits. Thus, it is another particular advantage of the present invention that the plurality of riffles 151 in the mineral separation bed 150 can separate out toxic mercury deposits in old mine tailings and placer ore thereby reclaiming the deposits and making them safer for environmental use.

The brush 80 can be disposed in the trough 50 above the mineral separation bed 150. The brush 80 can slow downstream movement of the slurry in the trough 50 toward the mineral separation bed 150 in order to provide additional settling time for the heavier minerals in the slurry to settle downward in the trough. Additionally, a backwash spigot 90 can be disposed in the trough 50 above the mineral separation bed 150 and downstream from the brush 80. The backwash spigot 90 can spray a continuous flow of water toward the brush 80 to create a standing wave. The standing wave can drive the slurry away from the brush 80 and the mineral separation bed 150 at an angle in order to move lighter material in the slurry away from the mineral separation bed and to provide for additional settling time for the slurry.

A dam 16 can be disposed near a back 14 of the separation device 10. Material that is so light that it will not settle is washed up and over the dam 16 by the standing wave. The dam 16 can be inclined downward towards the back 14 of the device causing this lighter material to exit the back 14 of the device 10 in liquid form. The back 14 of the device 10 can be sealed so that only material carried over the dam 16 may exit the back 14 of the device 10.

A plurality of collection receptacles 170 can be coupled to the plurality of riffles 151 to collect the minerals that have been separated or collected in the riffles by specific gravity. A separate collection receptacle 170 can be coupled to each of the separate riffles 152, 154 and 156 so that the minerals remain separated as they are collected. In one aspect, the collection receptacles can include a tube extending from the riffle to a collection container, such as a bottle.

The present invention also provides for a method for separating various constituents of an aggregate material including placing a load of aggregate material in a load hopper of an aggregate separation device. The aggregate material can be elutriated in the load hopper to form a slurry. The separation device can be shaken at a predetermined frequency to cause smaller particles of the slurry to pass through the plurality of separator screens and onto a mineral separation bed in the trough, and eject larger particles from an upper end of the separator screens. The flow of the slurry in on the mineral separation bed can be restricted by a brush disposed above the mineral separation bed and a continuous flow of water forming a standing wave adjacent the brush in order to provide time for heavier aggregate constituents to settle in the slurry. The heavier aggregate constituents of the aggregate material can be collected in a plurality of riffles or ribs in the mineral separation bed that are configured to separate or classify minerals by specific weight. The separated minerals in collected in the riffles or ribs can be removed from the separation device.

In another aspect, the present invention provides for method for separating various constituents of an aggregate including placing a load of aggregate material in a hopper of an aggregate separation device. The aggregate material in the hopper can be irrigated to form a slurry. The separation device can be shaken to cause smaller particles of the slurry to pass from the hopper, through at least one separator screen below the hopper, and into an upstream end of a trough disposed below the at least one separator screen. The flow of the slurry from the upstream end of the trough toward a downstream end of the trough can be restricted with a brush and a substantially continuous flow of water from a backwash spigot. The flow of water from the backwash spigot can form a standing wave adjacent the brush to drive the slurry upstream in order to provide time for heavier aggregate constituents to settle in the slurry. The trough can be shaken to move the slurry into a plurality of substantially longitudinal riffles extending from an upstream bottom of the trough to an elevated position along a side of the downstream end of the trough. Each riffle can be sized, shaped and oriented to separate minerals from the slurry by specific weight. The separated minerals collected in the plurality of substantially horizontal riffles can be removed from the aggregate material separation.

Although the above described device and method have been described as using water and forming a slurry, air or compressed air may also be used.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An aggregate material separating device, comprising:

a) a frame;

b) a trough, disposed on the frame and sized and shaped to move a slurry of aggregate material from an upstream end to a downstream end of the trough;

b) a shaker mechanism coupled to the frame to vibrate the frame and trough;

c) a loading hopper, disposed at the upstream end of the trough, and sized and shaped to receive a load of aggregate material and direct the aggregate material into the trough;

d) a hopper wash line, disposed adjacent the loading hopper, to supply a substantially continuous flow of water into the hopper to create the slurry from the aggregate material in the hopper;

e) at least one screen, disposed substantially between the trough and the loading hopper, and sized and shaped to receive slurry from the loading hopper and separate particles of a predetermined size from the slurry while allowing the remaining slurry to pass through the screen;

f) a plurality of substantially longitudinal riffles rising from a bottom of the trough below the separating screens to an elevated position at the downstream end of the trough, and each riffle sized, shaped and oriented to capture minerals of a predetermined specific gravity from the slurry;

g) a brush, disposed in the trough above the plurality of substantially longitudinal riffles, and sized and shaped to slow slurry movement from the upstream end of the trough to the plurality of substantially longitudinal riffles to provide additional settling time for the slurry; and h) a backwash spigot, disposed adjacent a downstream side of the brush, and having a nozzle positioned to spray a continuous flow of water toward the brush to create a standing wave and drive relatively lighter material of the slurry upstream from the plurality of substantially longitudinal riffles and allow relatively heavier material of the slurry to pass to the plurality of substantially longitudinal riffles.

2. The device in accordance with claim 1, wherein the plurality of riffles form a mineral separation bed extending longitudinally along the bottom and up a side of the trough and each of the plurality of riffles has a predetermined angular orientation with respect to the mineral separation bed and is configured to retain a material having an associated specific gravity.

3. The device in accordance with claim 2, wherein the shaker mechanism shakes the aggregate material device at a frequency that moves the slurry through the at least one separating screen, into the trough, past the brush, and along the mineral separation bed, such that materials in the slurry with a higher specific gravity are moved further up the elevated side of the mineral separation bed to a riffle that is relatively higher in elevation than material with a lower specific gravity.

4. The device in accordance with claim 1, wherein the at least one separating screen further comprises:

a plurality of successive screens disposed below the hopper and successively downstream from on another, each screen having openings sized and shaped to separate relatively smaller aggregate particles from the slurry with respect to an adjacent upstream screen while allowing the remaining slurry to pass through to the next adjacent downstream screen; and a plurality of curved ejection tubes, each associated with the one of the plurality of successive screens, and each tube sized and shaped to receive the separated particles from the associated screen and eject the separated particles from the aggregate material separating device.

5. A method for separating various constituents of an aggregate material comprising the steps of:

a) placing a load of aggregate material in a hopper of an aggregate separation device;

b) irrigating the aggregate material in the hopper to form a slurry;

c) shaking the separation device to cause smaller particles of the slurry to pass from the hopper, through at least one separator screen below the hopper, and into an upstream end of a trough disposed below the at least one separator screen;

d) restricting the flow of the slurry from the upstream end toward a downstream end of the trough with a brush and a continuous flow of water forming a standing wave adjacent the brush in order to provide time for heavier aggregate constituents to settle in the slurry;

e) shaking the trough to move the slurry into a plurality of substantially longitudinal riffles extending from an upstream bottom of the trough to an elevated position along a side of the downstream end of the trough, each riffle being sized, shaped and oriented to separate minerals from the slurry by specific weight; and f) removing the separated minerals collected in the plurality of substantially longitudinal riffles from the aggregate material separation.

6. The method in accordance with claim 5, further comprising ejecting larger particles from an upper end of the at least one separator screen in an ejection tube associated with the at least one separator screen.

7. The method in accordance with claim 5, wherein removing the separated minerals further includes collecting the separated minerals in a plurality of collection receptacles with each receptacle being positioned to collect separated minerals from an associated riffle.

8. An aggregate material separating device, comprising:

a) a frame;

b) a trough, disposed on the frame and sized and shaped to move a slurry of aggregate material from an upstream end to a downstream end of the trough;

b) a shaker mechanism coupled to the frame to vibrate the frame and trough;

c) a loading hopper, disposed at the upstream end of the trough, and sized and shaped to receive a load of aggregate material and direct the aggregate material into the trough;

d) a hopper wash line, disposed adjacent the loading hopper, to supply a substantially continuous flow of water into the hopper to create the slurry from the aggregate material in the hopper;

e) at least one screen, disposed substantially between the trough and the loading hopper, and sized and shaped to receive slurry from the loading hopper and separate particles of a predetermined size from the slurry while allowing the remaining slurry to pass through the screen;

f) a plurality of substantially longitudinal riffles rising from a bottom of the trough below the separating screens to an elevated position at the downstream end of the trough, and each riffle sized, shaped and oriented to capture minerals of a predetermined specific gravity from the slurry;

g) a plurality of successive screens disposed below the hopper and successively downstream from on another, each screen having openings sized and shaped to separate relatively smaller aggregate particles from the slurry with respect to an adjacent upstream screen while allowing the remaining slurry to pass through to the next adjacent downstream screen; and h) a plurality of curved ejection tubes, each associated with the one of the plurality of successive screens, and each tube sized and shaped to receive the separated particles from the associated screen and eject the separated particles from the aggregate material separating device.

9. The device in accordance with claim 8, further comprising:

a) a brush, disposed in the trough above the plurality of substantially longitudinal riffles, and sized and shaped to slow slurry movement from the upstream end of the trough to the plurality of substantially longitudinal riffles to provide additional settling time for the slurry; and b) a backwash spigot, disposed adjacent a downstream side of the brush, and having a nozzle positioned to spray a continuous flow of water toward the brush to create a standing wave and drive relatively lighter material of the slurry upstream from the plurality of substantially longitudinal riffles and allow relatively heavier material of the slurry to pass to the plurality of substantially longitudinal riffles.

10. The device in accordance with claim 8, wherein the plurality of riffles form a mineral separation bed extending longitudinally along the bottom and up a side of the trough and each of the plurality of riffles has a predetermined angular orientation with respect to the mineral separation bed and is configured to retain a material having an associated specific gravity.

11. The device in accordance with claim 10, wherein the shaker mechanism shakes the aggregate material device at a frequency that moves the slurry through the at least one separating screen, into the trough, past a brush, and along the mineral separation bed, such that materials in the slurry with a higher specific gravity are moved further up the elevated side of the mineral separation bed to a riffle that is relatively higher in elevation than material with a lower specific gravity.

* * * * *